US006976588B2

(12) United States Patent
Wischusen et al.

(10) Patent No.: US 6,976,588 B2
(45) Date of Patent: Dec. 20, 2005

(54) EASY-OPEN DISPLAY SHIPPING CONTAINER

(75) Inventors: Henry Wischusen, Norcross, GA (US); David Couture, Suwanee, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 128 days.

(21) Appl. No.: 10/358,809

(22) Filed: Feb. 5, 2003

(65) Prior Publication Data

US 2004/0149624 A1 Aug. 5, 2004

(51) Int. Cl.[7] ..... B65D 17/00

(52) U.S. Cl. ..... 206/736; 206/427; 206/774; 229/235; 229/238; 229/243

(58) Field of Search ..... 206/427, 557, 206/774, 736, 813; 229/235, 238, 243

(56) References Cited

U.S. PATENT DOCUMENTS

| | | | | |
|---|---|---|---|---|
| 2,706,076 A | | 4/1955 | Guyer | |
| 2,751,964 A | | 6/1956 | Guyer | |
| 3,097,784 A | | 7/1963 | Schaus | |
| 3,124,246 A | | 3/1964 | De Remer et al. | |
| 3,136,474 A | | 6/1964 | Schaus et al. | |
| 3,189,187 A | | 6/1965 | Guyer, Jr. et al. | |
| 3,276,665 A | | 10/1966 | Rasmussen | |
| 3,276,666 A | | 10/1966 | Johnson | |
| 3,276,667 A | | 10/1966 | Johnson et al. | |
| 3,469,766 A | | 9/1969 | Nelson | |
| 3,620,439 A | * | 11/1971 | Morse et al. | 229/208 |
| 3,773,248 A | * | 11/1973 | Cecil et al. | 229/207 |
| 3,786,914 A | | 1/1974 | Bentler | |
| 4,113,100 A | * | 9/1978 | Soja et al. | 229/112 |
| 4,558,785 A | | 12/1985 | Gordon | |
| 4,773,541 A | | 9/1988 | Riddell | |
| 4,778,059 A | | 10/1988 | Martin et al. | |
| 4,784,271 A | | 11/1988 | Wosaba, II et al. | |
| 5,050,741 A | | 9/1991 | Kim | |
| 5,098,757 A | | 3/1992 | Steel | |
| 5,332,150 A | | 7/1994 | Poirier | |
| 5,507,432 A | | 4/1996 | Cyr | |
| 5,979,749 A | | 11/1999 | Bozich | |
| 6,510,982 B2 | * | 1/2003 | White et al. | 229/235 |

FOREIGN PATENT DOCUMENTS

| | | |
|---|---|---|
| CA | 545601 | 9/1957 |
| CH | 421806 | 4/1967 |
| EP | 0 199 225 A2 | 10/1986 |
| EP | 0 571 197 A1 | 11/1993 |
| GB | 2 088 830 A | 6/1982 |
| GB | 2 238 776 A | 8/1991 |
| JP | 03275438 A | 3/1990 |

* cited by examiner

*Primary Examiner*—John A. Ricci
(74) *Attorney, Agent, or Firm*—Kilpatrick Stockton LLP

(57) ABSTRACT

An easy-open display shipping container formed from a tray and a cover secured to the tray. A portion of the tray may be covered with a material having a releasing property. An adhesive strip secures the cover to the tray. The material having a releasing property allows the adhesive strip to be easily removed from the container without damaging the tray. The container may be opened at a retail point of sale to display items contained in the container in the undamaged tray. Graphics, such as advertisements, may be embedded in the material having a releasing property.

14 Claims, 4 Drawing Sheets

EASY-OPEN DISPLAY SHIPPING CONTAINER

RELEVANT FIELD

This invention relates to a shipping container that can be easily opened to display product at a retail point of sale. More particularly, this invention relates to an easy-open display shipping container that can be converted from a shipping container to a display tray by removing an adhesive strip without damaging the resulting display tray.

BACKGROUND

It is often desirable for display shipping containers to be converted to display trays at a retail point of sale, avoiding the need to unpack product from a shipping container and restack it in a separate display tray.

Previous display shipping containers may be opened by removing a tear strip embedded in the shipping container at the retail point of sale, allowing a portion of the container to be removed such that the product is displayed in the remaining portion of the container. One such shipping container is disclosed in U.S. Pat. No. 2,706,076 issued Apr. 12, 1955 to Guyer. Guyer discloses a container with a removable tear strip of cardboard encircling the container, the removal of which releases the top portion of the container. Such tear strips are problematic, however, because the cardboard does not always tear evenly, or rips off before being fully removed, requiring the use of a knife to finish opening the container. If a knife is used, product in the container may be damaged during opening. For example, the knife may inadvertently penetrate the packaged product during opening. Such damaged product may be useless to the retailer.

The use of tear strips is also problematic because removal of the tear strip often causes portions of the resulting display tray to be torn or otherwise damaged resulting in an unattractive display tray that is not suitable for displaying product at a retail point of sale. This may require the contents of the container to be removed and re-arranged, occupying valuable employee time.

Shipping display containers with tear strips may also be problematic because removing the tear strip may require the container to be turned, repositioned, rotated, or otherwise moved during opening, requiring additional space during the opening process. This is particularly problematic when the containers are arranged in stacks on a pallet at a wholesale style retail point of sale, where opening the containers could require the stack to be significantly re-arranged, occupying a significant amount of time by store employees.

Another problem with tear strips is that a relatively large amount of effort may be required to remove them because the tear strip is an embedded portion of the container. Furthermore, tear strips may be difficult to predict and may tear a substantial portion of the display tray.

An alternative to the tear type strip containers is disclosed in U.S. Pat. No. 4,784,271 issued Nov. 15, 1988 to Wosaba, II et al. There, the container is separated into two halves by a cut encircling the container. A piece of wide tape with an embedded filament holds the two halves together. Removing the filament separates the two halves, allowing the container to be opened to display product. Removal of the filament requires tearing through the wide tape, resulting in the display tray having an unattractive appearance due to the edges of torn wide tape which remain on the tray and are visible. Such unattractive display trays are not suitable for displaying product at a retail point of sale. Another problem with the container described in Wosaba, and other display shipping containers, is that the resulting display tray is not stable, especially if it is subjected to damp conditions, such as when a floor at the retail point of sale is mopped or otherwise exposed to dampness. Additionally, Wosaba, and other easy-open display shipping containers, do not facilitate the placement of high-impact graphics on the display tray, nor do they protect any graphics placed on the container.

It is important to retailers for a shipping container to be easily opened, without requiring a knife or other tools, but to also attractively display product at a retail point of sale once opened. It is also important to be able to include, and protect, graphics, such as advertisements, on the display portion of the tray. It is also important that the containers be openable, even when the containers are arranged tightly together, such as when the containers are stacked on a shipping pallet, without having to substantially re-arrange the containers for opening. It is also important to be able to subject containers to moisture without the containers losing a significant amount of structural integrity. Various embodiments and aspects according to the present invention promote or carry out one or more, sometimes combinations, of these aspects.

SUMMARY

Various embodiments and aspects according to the present invention include an easy-open display shipping container that can be easily opened, without the use of a knife, to provide an attractive display for product at a retail point of sale. Containers according to certain embodiments of the present invention may include an easy-open display shipping container formed by a tray, a cover, a material with a releasing property applied to a portion of the tray, and an adhesive strip joining the tray and the cover together and at least partially overlaying the material with releasing property. The easy-open shipping container may be opened by removing the adhesive strip. The releasing property of the material applied to the tray allows the adhesive strip to be removed without substantially damaging the tray. Once the adhesive strip has been removed, the cover may be removed from the tray. Removing the cover at a retail point of sale allows product shipped in the container to be displayed in a protected, aesthetically pleasing, substantially undamaged tray without requiring the removal of the product from a shipping container and placement in a separate display tray, conserving valuable retail establishment employee time.

In certain embodiments of the present invention, the material with releasing property may be an adhesive strip. The material with releasing property may also contain high impact graphics, such as advertisements. Because the graphics are embedded in the adhesive strip, the graphics are protected against damage during packing, shipping, storing, display, and other uses associated with such containers. In other embodiments, the graphics can be placed or printed directly on the tray. It may be attractive to retail establishments to allow advertisements on the tray which requires no additional effort by store employees. The graphics may also be protected by the material with releasing property if the material with the releasing property is applied over the graphics such as a coating or layer. The provision for graphics may provide significant advertising space for certain products. For example, liquor bottles may be advertised in this manner, which may be attractive to that industry, or other industries like it which are not able to advertise on television. However, the provision for graphics may be attractive to industries which are able to advertise on television also.

In other embodiments of the present invention, the material with the releasing property may be applied to portions of the tray and the cover. Such containers may be desirable for avoiding damage to the tray and cover during opening. For example, one wall of the tray and cover may be joined like a hinge such that the cover forms a flip-top lid to the container. In other embodiments, the container may be secured closed after opening by applying another adhesive strip to portions of the tray and flip-top lid.

The tray and the cover may be formed in a variety of configurations and shapes, so long as at least some edges of the walls of the tray align with some edges of the walls of the cover, such that the adhesive strip may overlay portions of the tray and cover and portions of the material with releasing property, thereby securing the tray to the cover for shipping.

In certain embodiments of the present invention, a container may be formed with an opening in one of the walls. The opening may be filled with a panel shaped to fit the opening. The portions of the walls adjacent to the opening may be covered with a material with a releasing property. An adhesive strip may secure the panel, in the opening, to the wall, and may overlay at least a portion of the material with releasing property. Removing the adhesive strip allows the panel to be separated from the remainder of the container, allowing removal of product through the opening.

It is an object or advantage of certain embodiments of the present invention to provide an easy open shipping display container that can be easily opened without the use of a knife.

It is also an object or advantage of certain embodiments of the present invention to provide an easy open shipping display container that can be opened to produce an attractive display tray suitable for displaying product at a retail point of sale.

It is another object or advantage of certain embodiments of the present invention to provide an easy open shipping display container with protected graphics, such as advertisements.

It is another object or advantage of certain embodiments of the present invention to provide an easy open shipping display container that can be easily opened while the container is in a stacked configuration, such as on a pallet with other containers, without having to substantially rearrange the containers.

It is another object or advantage of certain embodiments of the present invention to provide an easy open shipping display container with increased stability and increased resistance to damp conditions.

DETAILED DESCRIPTION

Figure 1:
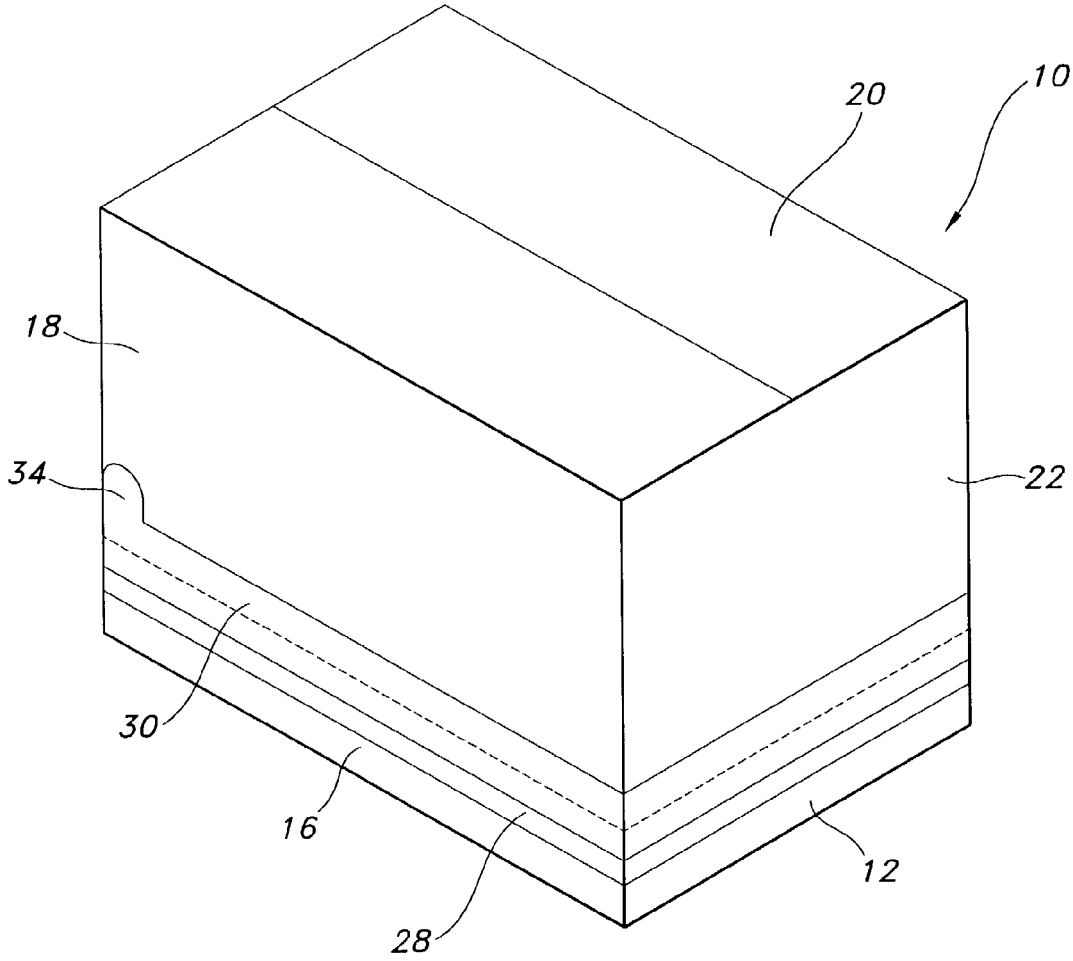
FIG. 1 shows a shipping container according to a first embodiment of this invention in perspective view.

FIG. 1 shows, in a perspective view, a shipping container 10 according to certain embodiments of the present invention. Shipping container 10 may be formed from corrugated cardboard, other cardboards, paperboard, fiberboard, plastic sheet, plastic corrugated sheet, or other suitable materials. Preferably, shipping container 10 is formed from corrugated cardboard. Shipping container 10 may be produced by using traditional, or non-traditional, methods of producing paperboard boxes, and may be produced in traditional, or non-traditional, sizes.

As shown in FIG. 1, in certain embodiments of the present invention, shipping container 10 is formed from a tray 12 and a cover 18. Tray 12 comprises four walls 16 and bottom panels 14 (shown in FIG. 2) which form a bottom surface of the tray. Cover 18 is formed from top panels 20 and four walls 22. The tray walls 16 and the cover walls 22 are oriented such that top edges of tray walls 26 line up with bottom edges of cover walls 24.

A portion of tray 12 adjacent to the top edge of the tray walls 26 is covered with a material 28 comprising a releasing property. It should be understood that the tray walls may be entirely covered with the releasing material 28 if desired. Alternatively, the tray walls do not have to be entirely covered with the releasing material 28 if desired. Preferably, releasing property of material 28 allows an adhesive strip 30 to be placed over the material 28 and removed from material 28 without destroying, marring, defacing, or otherwise damaging the material 28 or any portion of the tray that the material 28 is applied to. The releasing material 28 may also be applied to a portion or all of the cover 18 if it is desired to prevent the cover from damage during shipping, opening, or other uses associated with such containers. Material 28 may be an adhesive tape, a lamination treatment, a silicon releasing coating, or any other suitable material with releasing properties. In certain embodiments, material 28 comprises an adhesive tape. Adhesive tape may be paper packaging tape, plastic packaging tape, or any other suitable tape. Adhesive tape may be self wound tape. Preferably, adhesive tape is plastic, self wound, packaging tape. On such adhesive tape is Scotch® 375 packaging tape, produced by 3M, St. Paul, Minn.

In certain embodiments, material 28 is formed with embedded high impact graphics. The high impact graphics may be advertisements, safety messages, or any other suitable graphic or indicia. The releasing properties of the material 28, as well as other properties of material 28, may assist in protecting the graphics from damage associated with the use of various containers of the present invention such as packaging, shipping, storing, opening, displaying and other activities associated with the use of such containers. Alternatively, graphics, including advertisements, may be printed directly on the walls of the tray 16. Regardless of whether graphics are printed on tray walls 16 or embedded in material 28, material 28 may protect the graphics from damage during packaging, shipping, storage, opening of the container 10, display of product, and any other activities associated with the use of container 10.

Material 28 may preferably cover the entirety of the tray walls 16. Material 28 may also cover bottom surfaces of the tray and a portion, of the tray walls 16.

Material 28 can also add stability to container 10, including tray 12. Material 28 may add structural integrity to the tray walls 16. Additionally, material 28 may protect the tray 12 from damage from the uses commonly associated with containers. Material 28 may also protect tray 12 from tearing.

Material 28 may also provide stability to tray 12 by protecting tray 12 from exposure to moisture. Material 28 may include a water resistance property. For example, when material 28 is plastic packaging tape, a lamination treatment, a silicon coating, or any other suitable material with water resistance properties, material 28, and consequently container 10 including tray 12, will be able to withstand wet or moist conditions without a significant loss of structural integrity. One such adhesive tape is Scotch® 375 packaging tape, produced by 3M, St. Paul, Minn. The portions of tray 12 covered by material 28 with water resistance properties will be protected from wet or moist conditions. Furthermore, even if portions of tray 12 not protected by material 28 with water resistance properties are exposed to wet or moist conditions, thereby weakening the structural integrity of these portions, tray 12 as a whole may retain its structural integrity due to the portions of tray 12 protected and supported by material 28 with water resistance properties.

As shown in FIG. 1, cover 18 is secured to tray 12 with the adhesive strip 30. Adhesive strip 30 at least partially extends across a bottom portion of the cover 18 adjacent to the bottom edges of the cover walls 24 onto at least a portion of the material 28 covering the portion of a tray adjacent to the top edges of the tray walls 26. Adhesive strip 30 may be plastic packaging tape, paper packaging tape, self-wound packaging tape, or any other suitable tape. On such adhesive tape is Scotch® 375 packaging tape, produced by 3M, St. Paul, Minn.

The releasing property of material 28 allows adhesive strip 30 to be easily removed from container 10 without damaging any portion of the tray 12. Removal of adhesive strip 30 allows cover 18 to be removed from tray 12. In certain embodiments of the present invention, nicks 48 also secure the cover 18 to the tray 12. In that embodiment, the nicks 48 must be broken to remove cover 18 from tray 12, for example by slightly twisting the cover 18. Nicks 48 are useful for securing trays 12 to covers 18 while the containers 10 are being assembled. After the container has been shipped to the retail establishment, adhesive strip 30 may be easily removed at a retail point of sale releasing the cover 18 and allowing the packaged items to be displayed in the tray 16. This minimizes the amount of time spent by retail establishment employees in preparing the packaged goods for display. In certain embodiments, a plurality of containers 10 may be stacked on a pallet at a retail point of sale. The top row of containers 10 may be easily prepared for display by simply removing adhesive strips 30 from the containers 10. This can be accomplished while containers 10 are stacked on the pallet without requiring substantial moving or otherwise reorientation of any of the containers 10, because containers 10 may be opened simply by removing adhesive strip 30. Opening the containers 10 in this manner greatly reduces the amount of time spent and space needed at the retail point of sale preparing the product for display.

In certain embodiments of the present invention, as shown in FIG. 1, a removable section 34 is located in a cover wall 22 adjacent to the bottom edge of cover wall 24. Removable section 34 may be attached to adhesive strip 30. Removal of removable section 34 facilitates removing adhesive strip 30 from container 10 by providing a structure for a user to grasp during opening. Alternatively, a tab, or any other suitable structure, may be attached to adhesive strip 30 to facilitate removal of adhesive strip 30 from container 10.

Figure 3:
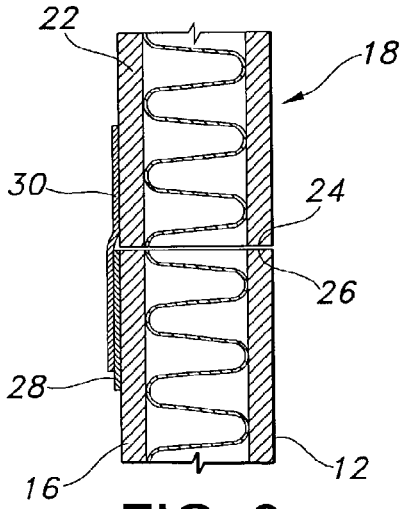
FIG. 3 shows a sectional side view of a wall of the shipping container of FIG. 1.
Figure 5:
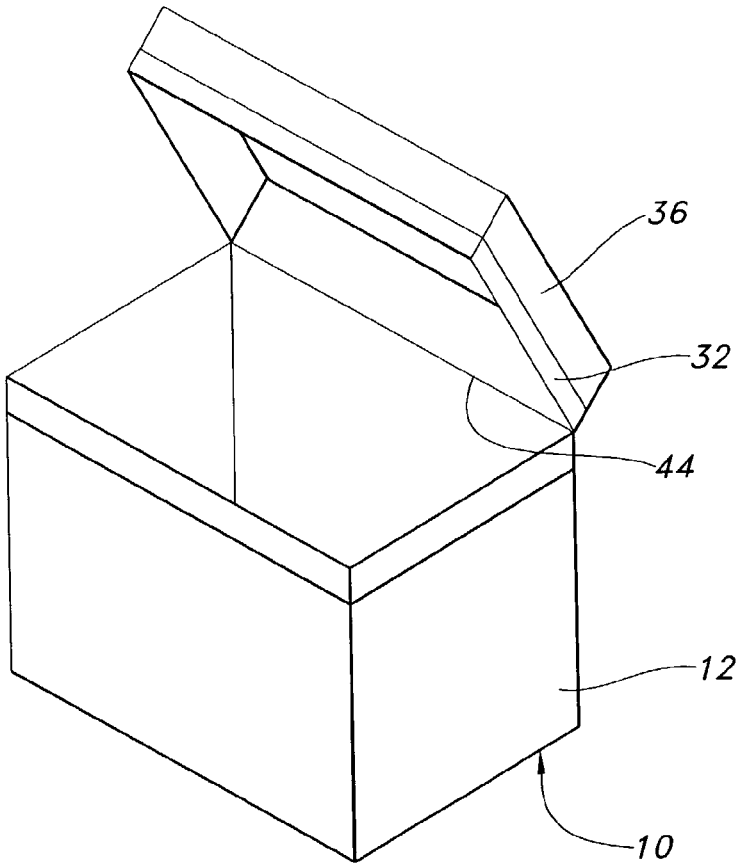
FIG. 5 shows a shipping container according to another embodiment of this invention shown in a perspective view in an open condition.

In certain embodiments of the present invention, as shown in FIG. 5, cover 18 may form a lid 36. Lid 36 may be attached to tray 12 at a hinge 44 between a wall of the tray 12 and a wall of the lid 36. A portion of lid 36 adjacent to bottom edge 24 may be coated with the material 28 with a releasing property such as described above with material 28 in FIG. 1 and FIG. 3. Material 28 protects lid 36 from damage when adhesive strip 30 is removed. Alternatively, another adhesive strip may be reapplied to the container illustrated in FIG. 5 to resecure the lid 36 to the tray 12.

Figure 6:
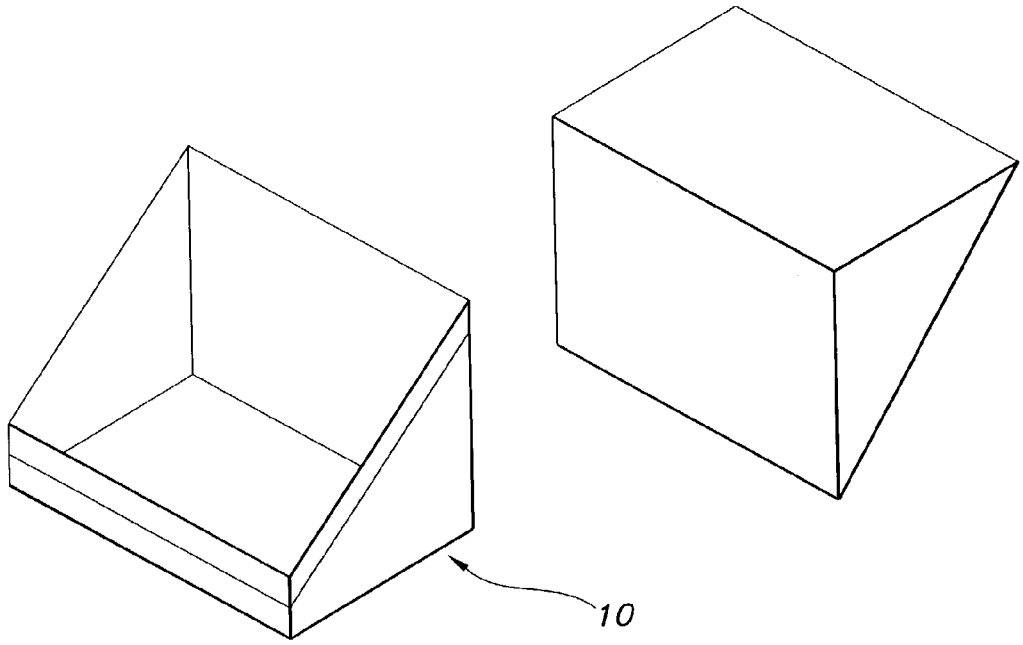
FIG. 6 shows a shipping container according to another embodiment of this invention shown in an exploded perspective view.

In another embodiment, container 10 may be formed from a plurality of different shapes. One such shape with a short front wall and tall rear wall is shown in FIG. 6. It should be understood that a variety of other shapes including non-rectangular boxes may be used without departing from the spirit of the invention.

Figure 7:
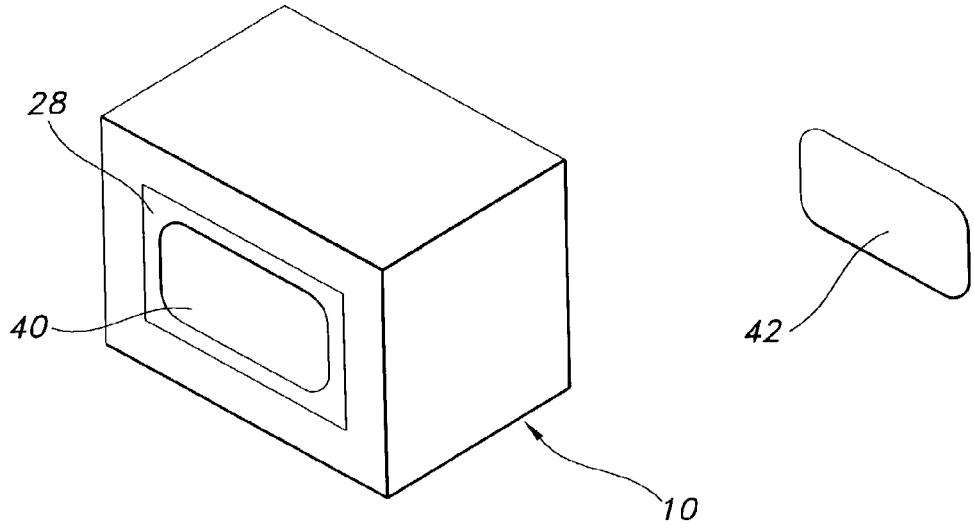
FIG. 7 shows a shipping container according to another embodiment of this invention shown in an exploded perspective view.

In other embodiments, as shown in FIG. 7, container 10 may be formed with a opening 40 and a panel 42 shaped to fill opening 40. Material 28 may be applied to portions of the container 10 adjacent to the opening 40. Panel 42 may be secured to container 10 by a number of adhesive strips, much like cover 18 is secured to tray 12 in FIG. 1. Removal of the adhesive strips allows panel 42 to be removed from container 10 without damage to the portions of container 10 adjacent to opening 40. Once panel 42 is removed from container 10, items contained within container 10 may be accessed. For example, the items contained within container 10 may be accessed by customers at a retail point of sale.

Figure 2:
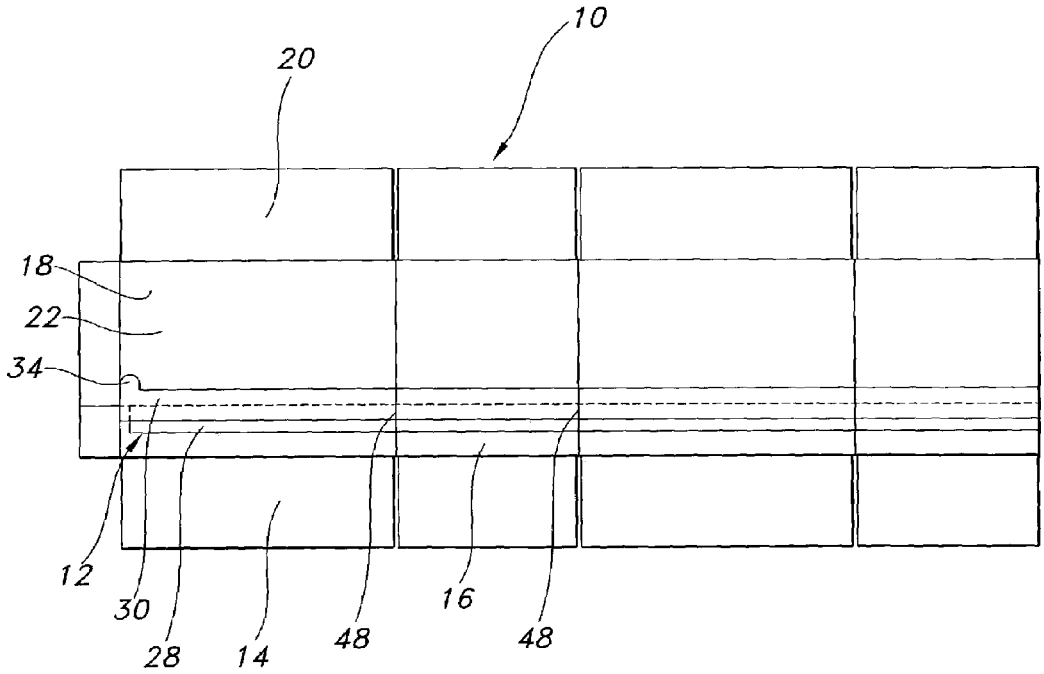
FIG. 2 shows a plan view of a blank used in forming the shipping container shown in FIG. 1.
Figure 4:
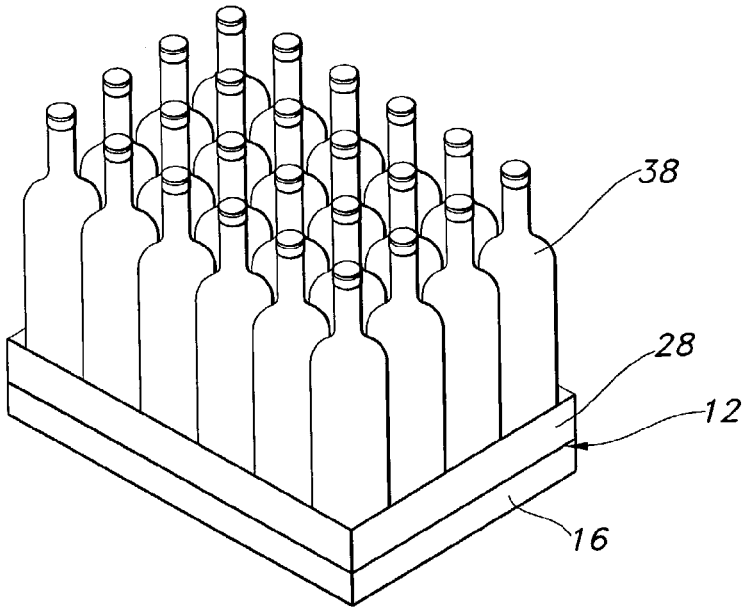
FIG. 4 shows a perspective view of the shipping container of FIG. 1, shown with a cover removed.

Shipping container 10 may be filled with items and sealed for shipping in the same manner as conventional shipping containers. Once the blank shown in FIG. 2 is formed, bottom panels 19 of container 10 may be folded over each other and then secured by any suitable means, such as adhesive tape. Subsequently, the container may be filled with product for shipment. Subsequently, top panels 20 may be folded over each other and secured as with bottom panels 14. Then, the container may be shipped to a retail point of sale and opened as described above.

In some embodiments of the present invention, shipping container 10 may be packed and otherwise prepared for shipping using the machinery used for packaging traditional shipping containers. For instance, in one embodiment, the container 10 may be formed from the blank shown in FIG. 2. Container 10 may subsequently be loaded with empty liquor bottles at a glass manufacturer and then sent to a distiller where the bottles are filled and sealed. Subsequently, container 10 may be sealed and sent to a retailer where an employee may easily open the container by removing the adhesive strip 30 and lifting the cover 18 from the container 10.

Changes and modifications, additions and deletions may be made to the structures recited above and shown in the drawings without departing from the scope or spirit of the invention.

What is claimed is:

1. A shipping container, comprising: (a) a tray, comprising a bottom surface and a plurality of walls; (b) a cover, comprising a top surface and a plurality of walls, the walls being situated such that bottom edges of the walls of the cover meet top edges of the walls of the tray when the cover is placed on the tray; (c) at least a portion of the tray adjacent to the top edges of the walls covered by a first material comprising a releasing property; (d) an overlaying adhesive strip at least partially extending across a bottom portion of the cover adjacent to the bottom edges of the walls onto at least a portion of the first material covering the portion of the tray adjacent to the top edges of the walls; and (e) whereby the releasing property of the first material allows the overlaying adhesive strip to be removed from the shipping container without significantly damaging the tray, allowing the cover to be removed, and the items shipped in the shipping container to be displayed for sale in the tray at a retail point of sale.

2. The shipping container of claim 1, wherein the first material further comprises a first base adhesive strip.

3. The shipping container of claim 2, wherein the first base adhesive strip further comprises embedded graphics.

4. The shipping container of claim 1, wherein the cover further comprises a removable section secured to the overlaying adhesive strip, whereby removal of the removable section facilitates removal of the overlaying adhesive strip.

5. The shipping container of claim 1, wherein the overlaying adhesive strip further comprises a tab attached to an end of the overlaying adhesive strip facilitating removal of the overlaying adhesive strip.

6. The shipping container of claim 1, wherein the first material further comprises a water-resistance property, whereby the water-resistance property creates a barrier to moisture allowing the tray to be subjected to wetting without a substantial loss of structural integrity.

7. The shipping container of claim 1, further comprising a wall of the tray attached to a wall of the cover forming a hinge, whereby the cover comprises a flip top lid.

8. The shipping container of claim 1, wherein the first material further comprises a first laminate.

9. The shipping container of claim 1, whereby the releasing property of the first material allows the overlaying adhesive strip to be removed from the shipping container and the cover to be removed without the use of a knife.

10. The shipping container of claim 1, wherein the tray, comprising a bottom surface and a plurality of walls and the cover, comprising a top surface and a plurality of walls, comprise paperboard.

11. The shipping container of claim 1, wherein the tray, comprising a bottom surface and a plurality of walls and the cover, comprising a top surface and a plurality of walls, further comprise corrugated cardboard.

12. An easy-open shipping display container, comprising: (a) a first means for containing and a second means for containing, the first means for containing and second means for containing at least partially separated by a means for separating, the first means for containing and the second means for containing, when combined, forming an enclosed container; (b) a first means for releasing applied to at least a portion of the first means for containing; (c) a means for securing applied to at least a portion of the first means for releasing and to at least a portion of the second means for containing, over at least a portion of the means for separating, securing the first means for containing to the second means for containing; and (d) whereby the second means for containing can be separated from first means for containing without damaging the first means for containing.

13. The easy-open display shipping container of claim 12, wherein the first means for releasing is applied to a section of the first means for containing adjacent to the means for separating.

14. A shipping container, comprising: (a) a tray, comprising a bottom surface and a plurality of walls; (b) a cover, comprising a top surface and a plurality of walls, the walls being situated such that bottom edges of the walls of the cover meet top edges of the walls of the tray when the cover is placed on the tray; (c) at least a portion of the tray adjacent to the top edges of the walls covered by a first material comprising a releasing property; (d) an overlaying adhesive strip at least partially extending across a bottom portion of the cover adjacent to the bottom edges of the walls onto at least a portion of the first material covering the portion of the tray adjacent to the top edges of the walls; and (e) whereby the releasing property of the first material allows the overlaying adhesive strip to be removed from the shipping container without significantly damaging the tray, allowing the cover to be removed.

* * * * *